US012104874B2

(12) United States Patent
Bubits

(10) Patent No.: US 12,104,874 B2
(45) Date of Patent: Oct. 1, 2024

(54) MAGAZINE OF A PISTOL FOR CARTRIDGES WITH A CASE RIM AND PISTOL WITH A SUCH

(71) Applicant: Erwin Bekto, Güssing (AT)

(72) Inventor: Wilhelm Bubits, Lutzmannsburg (AT)

(73) Assignee: Erwin Bekto, Güssing (AT)

( * ) Notice: Subject to any disclaimer, the term of this patent is extended or adjusted under 35 U.S.C. 154(b) by 28 days.

(21) Appl. No.: 18/189,006

(22) Filed: Mar. 23, 2023

(65) Prior Publication Data

US 2023/0304757 A1 Sep. 28, 2023

(30) Foreign Application Priority Data

Mar. 25, 2022 (AT) ..... A 8014/2022

(51) Int. Cl.
*F41A 9/69* (2006.01)
*F41A 9/41* (2006.01)
*F41A 9/70* (2006.01)

(52) U.S. Cl.
CPC ..... *F41A 9/69* (2013.01); *F41A 9/41* (2013.01); *F41A 9/70* (2013.01)

(58) Field of Classification Search
CPC ..... F41A 9/65; F41A 9/69; F41A 9/70; F41A 9/71
See application file for complete search history.

(56) References Cited

U.S. PATENT DOCUMENTS 3,453,762 A * 7/1969 Fremont ..... F41A 9/67 42/50
4,876,813 A * 10/1989 Tuma ..... F41A 9/70 42/50
4,888,899 A * 12/1989 Chesnut ..... F41A 9/70 42/50
5,386,657 A * 2/1995 Racheli ..... F41A 9/69 42/50
5,507,110 A * 4/1996 Chesnut ..... F41A 9/65 89/34
5,642,582 A * 7/1997 Grams ..... F41A 9/65 42/50
5,666,752 A * 9/1997 Grams ..... F41A 9/71 42/49.02
11,035,635 B2 6/2021 Bubits
(Continued)

FOREIGN PATENT DOCUMENTS

AT 518391 A4 10/2017
DE 3305772 A1 9/1983
DE 10111691 A1 9/2002

*Primary Examiner* — Gabriel J. Klein
(74) *Attorney, Agent, or Firm* — McCoy Russell LLP

(57) ABSTRACT

A magazine of a pistol for cartridges of the caliber .22LR with a case rim, consisting of a hollow magazine body for receiving the cartridges in two rows, a stub-like base plate, a feeder slidably guided in the magazine body, a compression spring between the feeder and the base plate, which base plate has a bore as do the two side walls of the magazine body comprise openings, all of which are formed by a transversely extending bolt, wherein the upper end region of the magazine body forms a constriction in which two rows of cartridges are brought together into one. The side walls have inwardly directed corrugations running longitudinally over their entire height, which merge with guide ribs in the upper region.

5 Claims, 5 Drawing Sheets

(56) References Cited

U.S. PATENT DOCUMENTS

| | | | | |
|---|---|---|---|---|
| 2005/0011097 | A1* | 1/2005 | Freed | F41A 9/65<br>42/49.02 |
| 2013/0247437 | A1* | 9/2013 | Obermeit | F41A 9/69<br>42/49.01 |
| 2015/0192377 | A1* | 7/2015 | Larson, Jr. | F41A 9/65<br>42/50 |
| 2020/0240729 | A1* | 7/2020 | Bubits | F41A 9/70 |
| 2023/0304757 | A1* | 9/2023 | Bubits | F41A 9/41 |

* cited by examiner

MAGAZINE OF A PISTOL FOR CARTRIDGES WITH A CASE RIM AND PISTOL WITH A SUCH

CROSS-REFERENCE TO RELATED APPLICATION

The present application claims priority to Austrian Patent Application No. A 8014/2022 filed on Mar. 25, 2022. The entire contents of the above-listed application are hereby incorporated by reference for all purposes.

TECHNICAL FIELD

The disclosure relates to a magazine of a pistol for cartridges with a case rim in .22 caliber, consisting of a magazine body formed by two side walls, a front wall and a rear wall for receiving the cartridges in two rows, of a base plate, a feeder slidably guided in the magazine body and a compression spring between the feeder and the base plate, the upper end region of the magazine body forming a constriction in which the two rows of cartridges are brought together.

BACKGROUND

Cartridges with a case rim, especially cartridges of the caliber .22LR or .22 Magnum, are very common in the field of shooting sports or hunting. In these cartridges, the primer is usually located on the rim rather than in the center of the case base. The case rim has a larger diameter than the cartridge. This makes nesting of the cartridges in the magazine difficult. Therefore, as a rule, only magazines with one row of cartridges, the capacity of which is limited to 8 to 12 cartridges, or complicated banana-shaped magazine bodies are created.

SUMMARY

A magazine made of plastic for the .22 Magnum cartridge is known in the state of the art, in which magazine the cartridges are fed up to the magazine lips in two rows separated from each other by a partition. A disadvantage is the unsafe feeding of the cartridge into the chamber of the barrel, since a cartridge is fed alternately from one row and from the other. It also means that the overall width of the pistol, especially the grip, has to be increased. For this reason, almost all pistols of other calibers are also equipped with magazines that narrow towards the top.

Furthermore, a double-row magazine for cartridges of caliber 7.65 mm or 6.35 mm, which are not described in detail, is known from DE 33 05 772 A1. These cartridges are those with grooves for the engagement of the extractor. Beads are formed on the side walls in such a way that the cartridges of the two rows are fed particularly "slowly."

Also known from DE 101 11 691 is a single-row magazine for a long gun, the feeder of which, acted upon by only one spring, is curved in such a way that it acts like a cartridge and functions as a special method for transporting the cartridges.

Finally, a magazine is known from AT 518391 which eliminates the shortcomings of the aforementioned technical solutions and has proven itself in practice. The disadvantage is the very complex production of the magazine body with four additional beads to stabilize the two cylindrical pressure springs and two guide tabs which keep the uppermost cartridge centered during feeding.

The task of the present disclosure is to propose a magazine for cartridges with a case rim in .22LR caliber that retains the functionally relevant advantages of the solution according to AT 518391, but without additional beads, guide tabs and without balcony-like retaining guides for the base plate, which as the state of the art usually run bent outward or inward, as well as without a locking plate, which is necessary for locking the base plate. Finally, one of the two compression springs is also omitted.

This is achieved with features of the present application. The inwardly directed first corrugations form the lateral guide of the cartridges. The side walls of the magazine are spaced slightly further apart to provide space for the case edges. The corrugations, which converge at a small angle at the top, unite the two rows of cartridges. However, since the side walls of the magazine do not yet converge, the case edges still have enough free space to position themselves. The correct nesting of the cartridges is achieved in conjunction with the angular ranges between 31 and 34 or 14 to 17 angular degrees; preferably these are 32 or 14 angular degrees. These now flatter angles prevent the uppermost cartridge from tilting slightly downward in the feed direction with the bullet when the nose of the carriage presses on the upper edge of the cartridge base (so-called "Dive Down Syndrome"). Thus, feeding the top cartridge into the barrel is functionally safe even with critical bullet shapes.

The closure of the magazine body is ensured by a stub-like base plate which extends somewhat into the interior of the magazine body, on which the compression spring is supported, and which has a transverse bore to the direction of firing. In the lowermost area of each of the two side surfaces of the magazine body there is an opening corresponding to the hole in the base plate. These two openings and the hole in the base plate are penetrated by a bolt which holds the compression spring, the feeder and the base plate in the magazine body.

An embodiment is that the bolt comprises at least one circumferential groove—there could also be two of them—in which the last coil of the compression spring engages, thus ensuring a secure fit of the bolt. By overpressing the spring force of the compression spring, the bolt can be easily removed or installed. It can be made of metal or, optionally, a plastic injection-molded part which is injection-molded together with the base plate, which is also made of plastic, at low cost.

The present disclosure is about a pistol with a magazine for the cartridge .22LR.

In the following, the disclosure is described and explained with reference to illustrations of an embodiment of the disclosure.

BRIEF DESCRIPTION OF THE FIGURES

It depicts.

DETAILED DESCRIPTION

Figure 1:
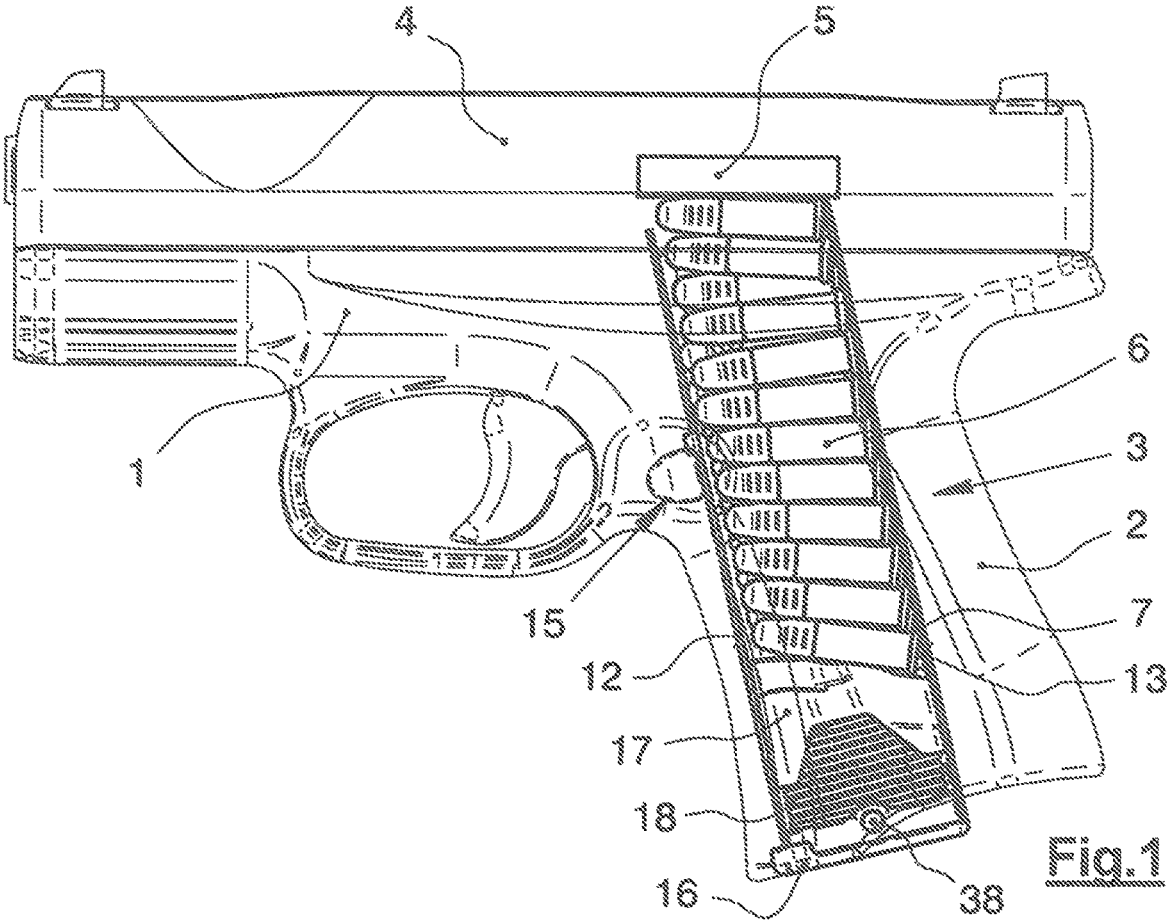
FIG. 1: View of a pistol with the magazine according to the disclosure.

In FIG. 1, a pistol is indicated only by its housing 1 with a grip piece 2 and by a barrel slide 4 with a follower lug 5. In the grip piece 2 a shaft is formed for a magazine 3. The magazine 3 holds cartridges 6 with a case rim 7, the diameter of which is larger than that of the cartridge 6. The magazine 3 can be inserted into the grip 2 from below and is fixed by means of a locking device 15.

Figure 2:
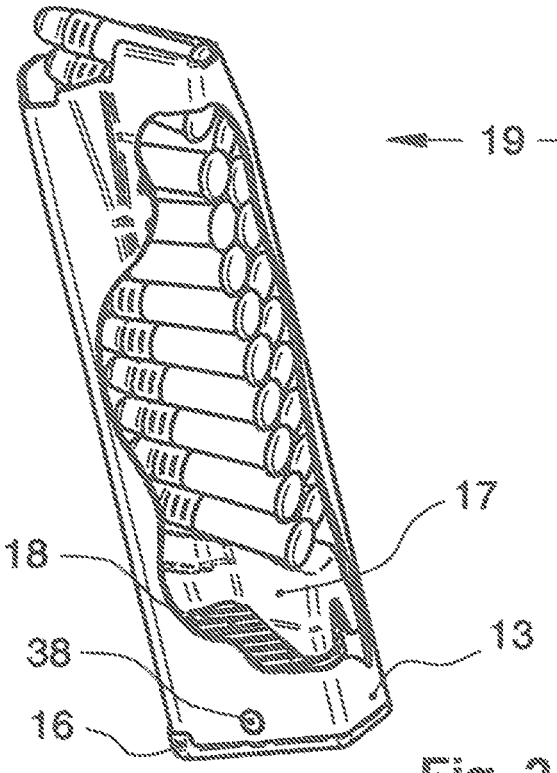
FIG. 2: Axonometric view of the magazine, partially torn open.
Figure 3:
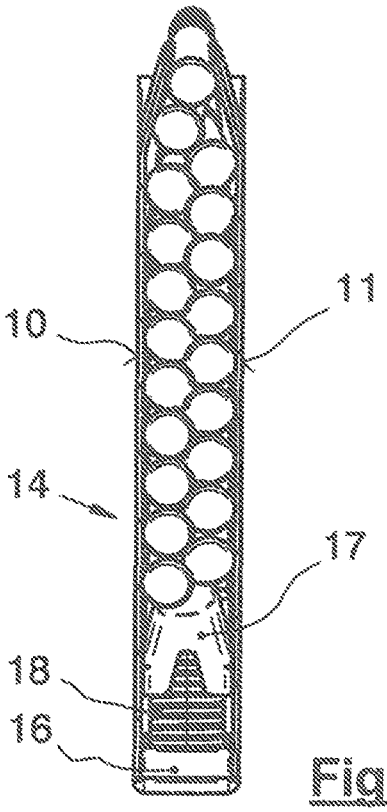
FIG. 3: Rear view of the magazine of FIG. 2.

In FIGS. 2 and 3, the magazine can be seen. It consists of a hollow elongated magazine body 14, a base plate 16, a feeder 17, and a compression spring 18 between the feeder 17 and the base plate 16. The magazine body 14 has a substantially fairly rectangular cross-section and is formed by two side walls 10, 11, a front wall 12 and a rear wall 13. The magazine body 14 accommodates the cartridges 6 in two vertically staggered rows which are brought together in a constriction 19 at the upper end to form a row.

The directional indications herein and in the claims refer to the pistol being held by a shooter in the direction of firing. FIGS. 1-14 are drawn to scale, although other relative dimensions may be used.

Figure 4:
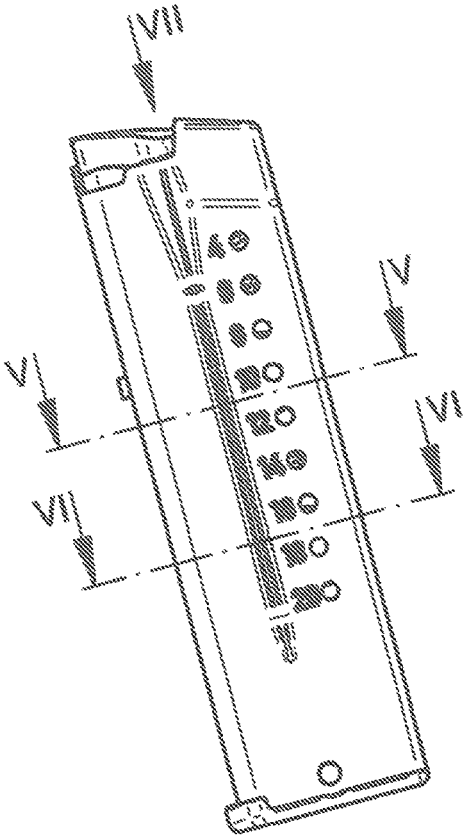
FIG. 4: Side view of the magazine.

FIG. 4 shows the magazine in side view and is used only for the purpose of associating the following FIGS. 5 to 14.

Figure 5:
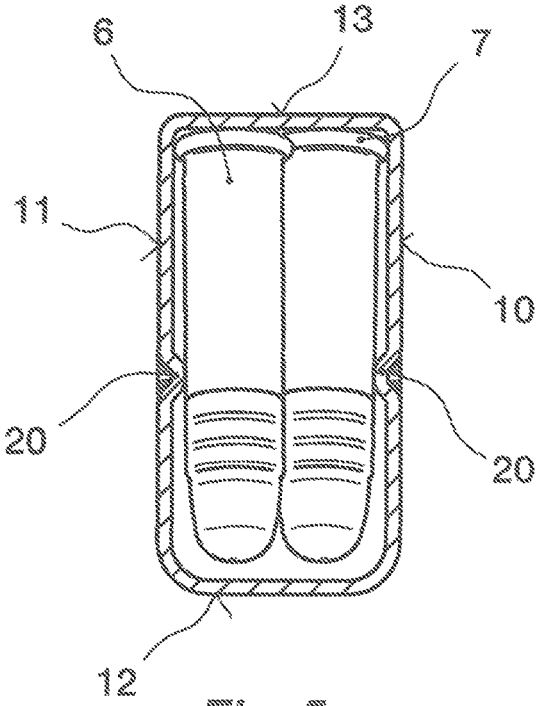
FIG. 5: Section to V-V in FIG. 4.

In FIG. 5, the cross-section through the magazine 3 is guided above the feeder 17. It shows the cartridges 6 in two rows offset from each other in the height direction. It can be seen that the cartridges are guided by first inwardly directed corrugations 20 in the side walls 10, 11. The clear width between the side walls 10, 11 is larger to allow space for the protruding case edges 7.

Figure 6:
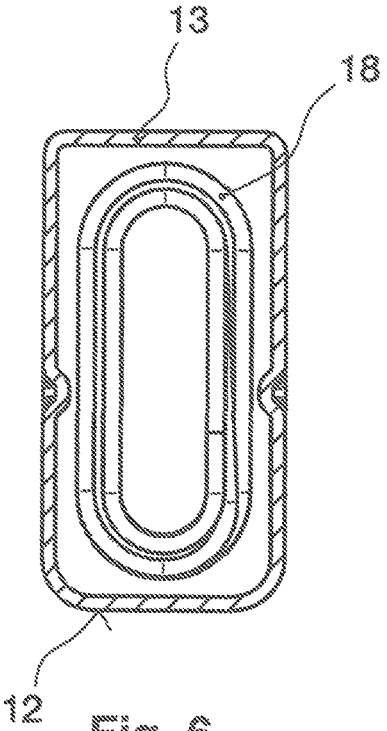
FIG. 6: Sectional view to VI-VI in FIG. 4.

In FIG. 6, the cross-section through the magazine 3 is guided under the feeder 17. The compression spring 18 acts on this, which largely corresponds to the shape of the magazine body in that the uppermost coils are narrower than those arranged below. This design corresponds to the state of the art, but is dependent on the caliber and weight of the respective cartridge type with respect to spring forces and installation length.

Figure 7:
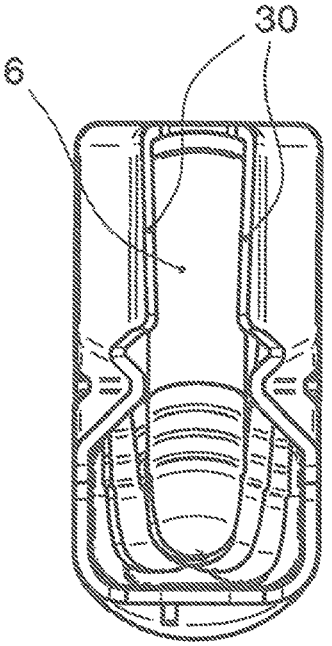
FIG. 7: Top view to VII in FIG. 4.

FIG. 7 shows a constriction 19 of the magazine body 14 in the upper end region, in which the side walls 10, 11 (FIG. 5) form inwardly inclined end regions 23, 24 (FIG. 9) and, with their upper edge, magazine lips 30. Each of these hold a cartridge 6 ready to be pushed by the follower lug 5 (FIG. 11) into the cartridge chamber of the barrel, which is not shown. The formation of the constriction 19 (FIGS. 2,3) in which the two rows are brought together is essential; also evident from the sections of FIGS. 9 and 10.

Figure 8:
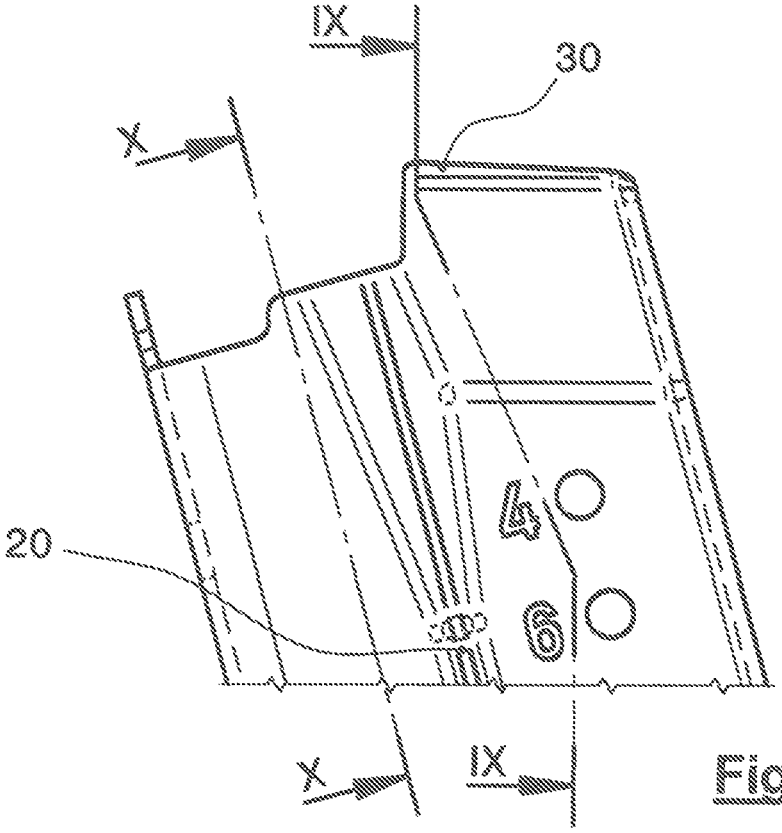
FIG. 8: Lateral view of the upper section of the magazine body.

FIG. 8 shows the left view of the upper part of the magazine body 14 with the magazine lips 30 and inwardly directed lateral corrugation 20.

Figure 9:
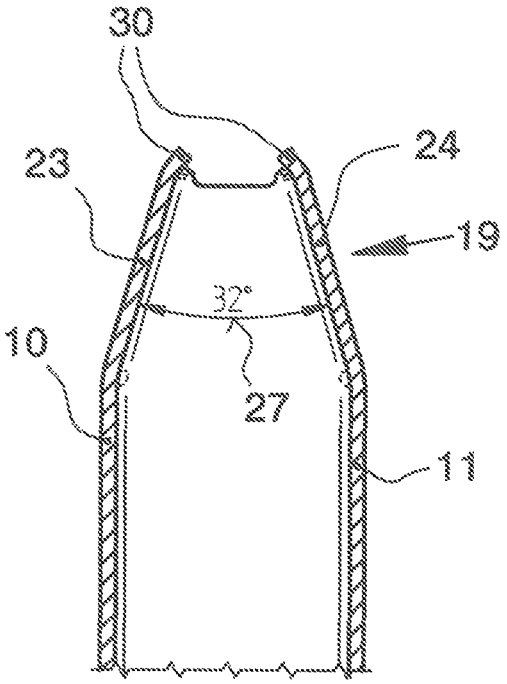
FIG. 9: Sectional view according to IX-IX in FIG. 8.
Figure 10:
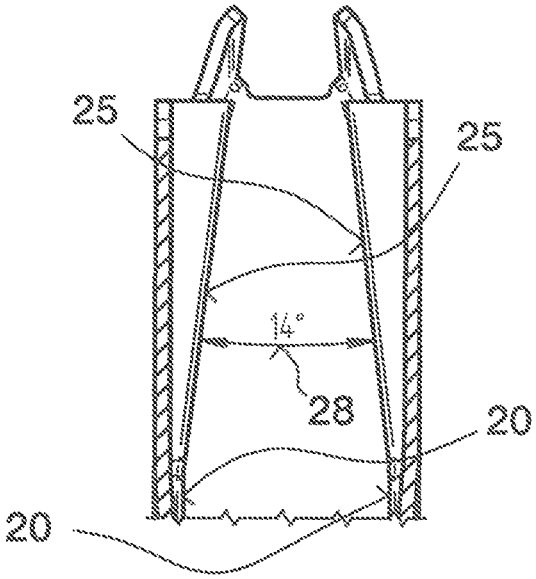
FIG. 10: Sectional view to X-X in FIG. 8.

FIGS. 9 and 10, show that the end portions of the side walls 23, 24 are inwardly inclined by a first angle 27. The corrugations 20 (FIGS. 5,10) are recessed in the region of the constriction 19 and form guide ribs 25 (FIG. 10) inclined inwardly by a second angle 28. The second angle 28 is about half the size of the first angle 27, thus the guide ribs 25 extend further downward. This has the effect that the cartridges of the two rows are guided one upon the other by the guide ribs 25 because of the small second angle 28, while their case edges still have sufficient freedom of movement between the side walls 10, 11 and only later between the end parts of the side walls 23, 24 inclined at the first angle 27.

Figure 11:
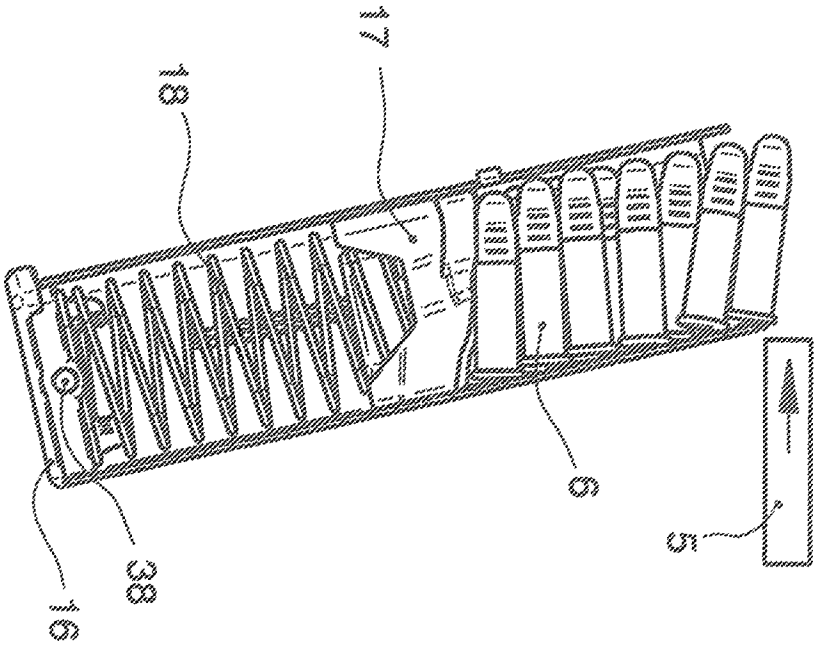
FIG. 11: The magazine filled with 10 cartridges.

In FIG. 11, the follower lug 5 is in the rear position before it pushes with its front surface the uppermost cartridge located between the magazine lips 30 into the cartridge chamber. The magazine is filled with 10 cartridges in .22LR caliber.

Figure 12:
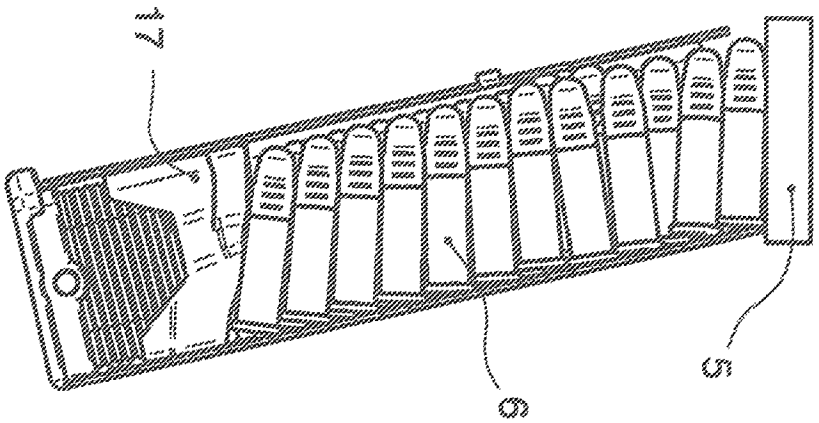
FIG. 12: The magazine filled with 20 cartridges.

In FIG. 12, the follower lug 5 is in the forwardmost position, and the uppermost cartridge lies against the underside of the follower lug 5 in a nearly horizontal position; the magazine is filled with 20 . 22LR caliber cartridges.

Figure 13:
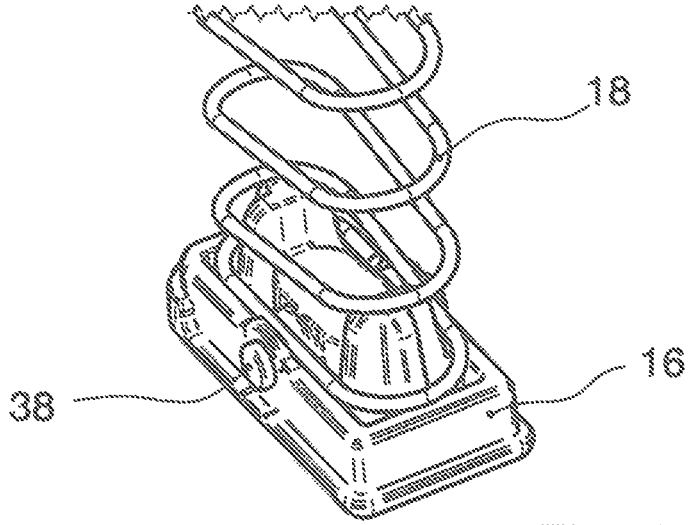
FIG. 13: The base plate with pin and the compression spring indicated.
Figure 14:
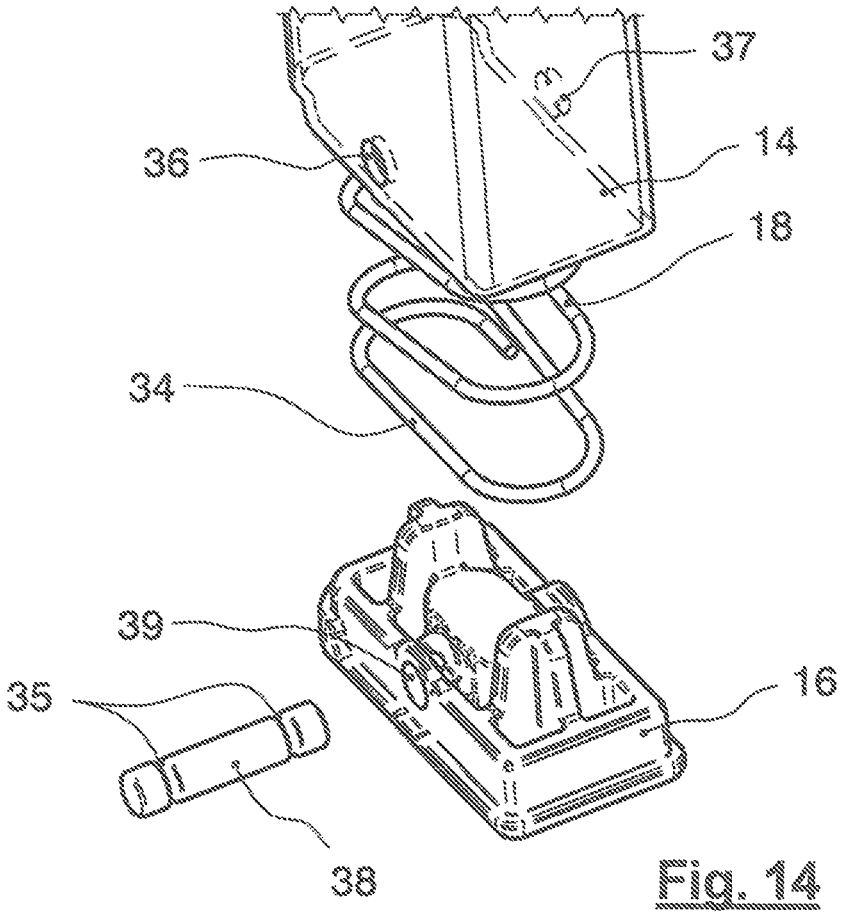
FIG. 14: The magazine body and the compression spring indicated as well as the bolt and base plate.

FIGS. 13 and 14—in FIG. 14, the openings 36, 37 in the lower region of the side walls 10, 11 can be seen, which—like the bore 39 of the base plate 16—are penetrated by the bolt 38 when the magazine is assembled, with the first coil 34 of the compression spring 18 engaging in at least one of the two grooves 35 of the bolt 38 (FIG. 13).

In a magazine for .22LR caliber cartridges according to the disclosure, the first angle 27 (FIG. 9) is 32 angular degrees, thus lying in a range between 31 and 34 angular degrees, and the second angle 28 (FIG. 10) is 14 angular degrees, which lies in a range between 14 and 17 degrees angular.

REFERENCE SIGNS

1 Housing
2 Grip piece
3 Magazine
4 Slide
5 Follower lug—slide
6 Cartridge .22LR
7 Case rim
8 ---
9 ---
10 Left side wall
11 Right side wall
12 Front wall
13 Rear wall
14 Magazine body
15 Magazine holder
16 Base plate
17 Feeder
18 Compression spring
19 Constriction
20 Corrugation
21 ---
22 ---
23 Left side wall inclined
24 Right side wall inclined
25 First corrugation inclined, guide rib
26 ---
27 First angle
28 Second angle
29 ---
30 Magazine lips
31 ---
32 ---
33 ---
34 Bottom coil of compression spring
35 Grooves in bolt
36 Opening left in magazine body
37 Opening right in magazine body
38 Bolt
39 Hole in base plate

The invention claimed is:

1. A magazine for cartridges with a case rim of .22LR caliber, consisting of a magazine body formed by two side walls, a front wall, and a rear wall for receiving the cartridges in two rows; a base plate; a feeder slidably guided in the magazine body; and a compression spring between the feeder and the base plate, wherein an upper end region of the magazine body forms a constriction in which two rows of cartridges are brought together into one, wherein the side walls of the magazine body form, at a top in a rear region, inwardly inclined parts inclined by a first angle and thus forming magazine lips which enclose an uppermost cartridge centrally, and the magazine lips enclose an angle of at most 34 degrees; the side walls comprise inwardly directed corrugations running longitudinally centrally over an entire height, which merge in the upper end region of the magazine body into converging guide ribs, and inner edges of the corrugations extend inwardly and enclose a second angle of at most 17 degrees; and the base plate comprises a bore, and the side walls of the magazine body comprise openings, and a bolt passes through the bore of the base plate and the openings of the side walls.

2. Magazine according to claim 1, wherein the first angle is selected between 31 and 34 degrees and the second angle between 14 and 17 degrees.

3. Magazine according to claim 1, wherein the bolt, penetrating the side walls and the base plate, comprises at least one circumferential groove in which a lowest coil of the compression spring engages.

4. Magazine according to claim 1, wherein the bolt is a plastic injection-molded part.

5. A pistol with a magazine according to claim 1.

* * * * *